US005327589A

United States Patent [19]

Rice

[11] Patent Number: 5,327,589

[45] Date of Patent: Jul. 12, 1994

[54] TOILET SEAT RAISING MECHANISM

[76] Inventor: George Rice, 15802 Mansfield, Detroit, Mich. 48227

[21] Appl. No.: 25,770

[22] Filed: Mar. 3, 1993

[51] Int. Cl.[5] ..... A47K 13/10

[52] U.S. Cl. ..... 4/246.2; 4/246.3

[58] Field of Search ..... 4/246.1, 246.2, 246.3, 4/246.4, 246.5, 248, 251.1, 251.2; 74/89.15; 220/211, 244, 262, 263, 264

[56] References Cited

U.S. PATENT DOCUMENTS

| | | | |
|---|---|---|---|
| 428,001 | 5/1890 | Kaley | 4/246.3 |
| 765,643 | 7/1904 | Tregoning | 4/246.4 |
| 1,511,533 | 10/1924 | Staszak . | |
| 1,590,298 | 6/1926 | Landis | 4/246.5 |
| 2,160,100 | 5/1939 | Crawford | 4/244.3 |
| 2,954,565 | 10/1960 | Miller | 4/251 |
| 3,284,810 | 11/1966 | Stokes | 4/246.1 |
| 3,516,095 | 6/1970 | Clifton et al. | 4/246.5 |
| 4,165,013 | 8/1979 | Lutz | 220/264 |
| 4,534,073 | 8/1985 | Smith | 4/251 |
| 4,807,307 | 2/1989 | Sato | 4/251 |
| 4,862,525 | 9/1989 | Cheng | 4/251 |
| 5,129,112 | 7/1992 | Schaeffer | 4/562.1 |

FOREIGN PATENT DOCUMENTS 485432 10/1929 Fed. Rep. of Germany ..... 220/263

*Primary Examiner*—Henry J. Recla
*Assistant Examiner*—Gregory M. Vidovich
*Attorney, Agent, or Firm*—Charles W. Chandler

[57] ABSTRACT

A mechanism for raising a toilet seat includes a foot pedal that operates or controls a slotted lifting lever located below a pneumatic cylinder assembly. Upward arcuate motion of the lever exerts a lifting force on the lower end of the cylinder portion of the cylinder assembly, such that the toilet seat is swung upwardly to a generally vertical position controlled by the seat hinge adjacent the top end of the cylinder. When foot pressure is removed from the pedal, the toilet seat returns to its lowered position. During this time, the pneumatic cylinder assembly acts as a shock absorber to prevent the seat from forcibly impacting against the toilet bowl as it reaches the lowered position. The foot pedal can be mechanically connected to the lifting lever. In an alternative arrangement, the foot pedal actuates an electric switch, that energizes an electric motor. The motor provides the motive power for moving the lifting lever.

14 Claims, 2 Drawing Sheets

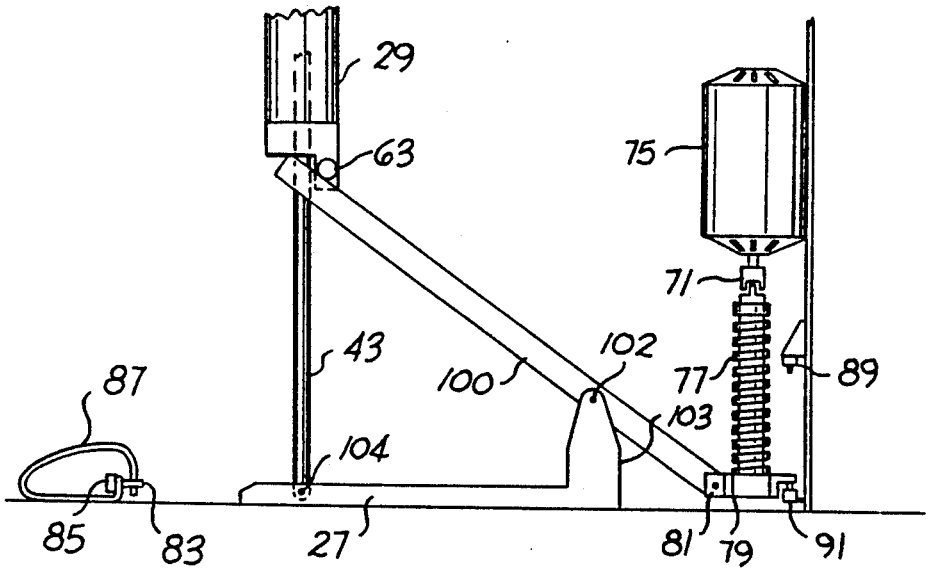
FIG. 6
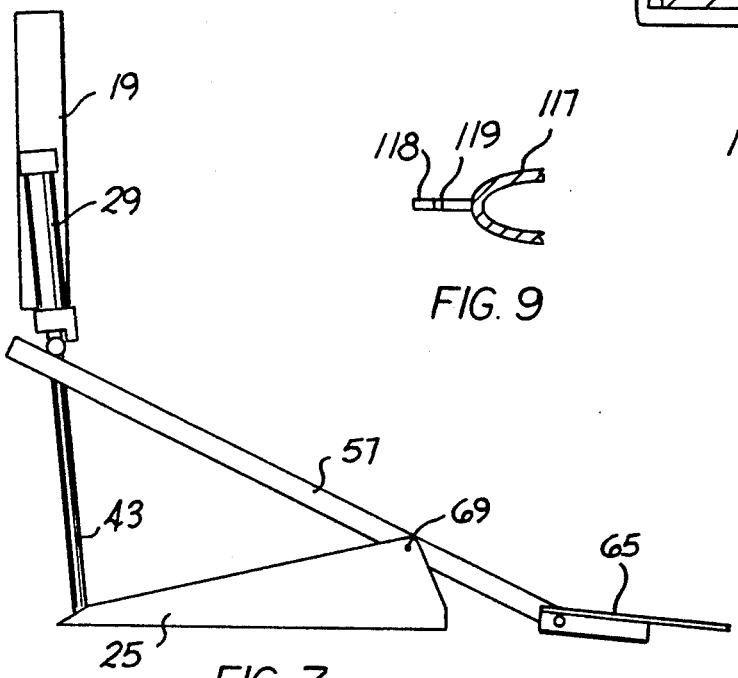
FIG. 7
FIG. 9
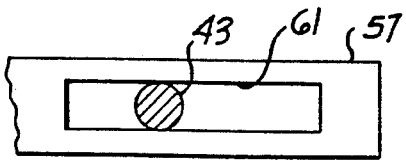
FIG. 10
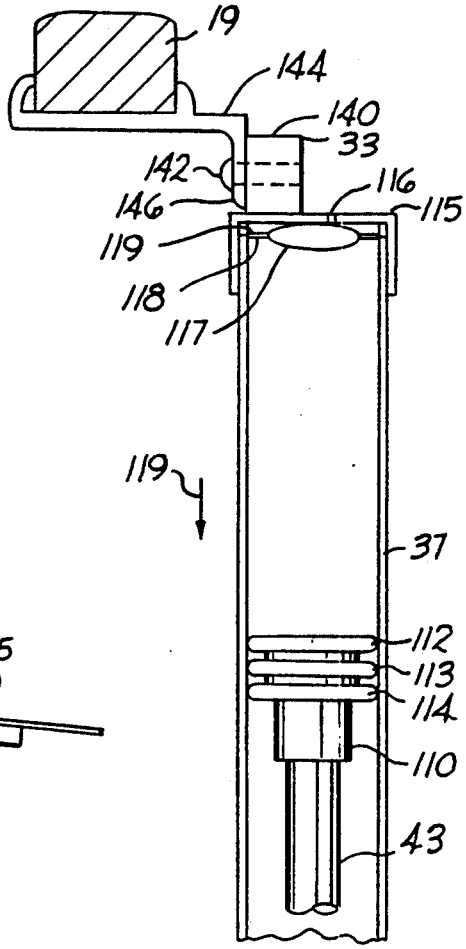
FIG. 8

TOILET SEAT RAISING MECHANISM

FIELD OF THE INVENTION

This invention relates to toilet seats, and particularly to foot-operated (or foot-controlled) mechanisms for raising a toilet seat.

PRIOR ART DEVELOPMENTS

Various mechanisms have been devised for raising a toilet seat, using the person's foot as the operator or controller of the process. Such foot-controlled seat raising mechanisms are advantageous because the user avoids the bending or stooping associated with raising or lowering the seat by hand. Also, when the user's hands do not come into direct contact with the undersurface of the seat, thus minimizing possible contact with germs. Further foot-controlled seat raising mechanisms can be designed so that when the person's foot is removed from the pedal controller, the seat automatically returns to its lowered position.

Foot-operated toilet seat raising mechanisms are shown in U.S. Pat. No. 1,511,533 to W. Staszak, U.S. Pat. No. 2,954,565 to M. Miller, U.S. Pat. No. 4,534,073 to G. Smith, U.S. Pat. No. 4,807,307 to T. Sato, and U.S. Pat. No. 4,862,525 to C. Cheng. The devices shown in these patents suffer to a certain extent in that they lack satisfactory shock absorber features for cushioning the downward movement of the toilet seat after the person's foot has been removed from the pedal controller. If a toilet seat is allowed to swing downwardly without controlling its motion, a loud banging sound is generated. Also, repeated forceful impacts of the seat against the rim area of the toilet bowl can, over time, damage the seat structure.

Some of the patented seat-raising mechanisms include spring type cushions for softening the downward impact of the toilet seat against the toilet bowl rim. However, such spring devices do not adapt to different seat weights or different operating forces. Also, if such spring devices are designed to exert the necessary cushioning force, they have the undesired effect of raising (holding) the seat away from the toilet bowl rim when the seat is in its lowered position.

Another disadvantage of the patented seat-raising mechanisms is that in most cases the foot pedal is elevated above floor. The person using the mechanism must lift his foot a significant distance from the floor. While the person is exerting a downward foot pressure on the pedal, the pressure-applying foot is elevated relative to the other foot (on the floor surface). The person is thus forced into an awkward stance, wherein his body weight is balanced unevenly, with a predominant part of the weight on the lowered foot.

SUMMARY OF THE INVENTION

The present invention contemplates a foot-operated (or foot-controlled) mechanism for raising a toilet seat, wherein the lifting force is applied to the seat through an extensible-contractible pneumatic cylinder means. During the lowering motion of the toilet seat, the pneumatic cylinder acts as a shock absorber cushioning the downward force of the toilet seat against the toilet bowl rim. An adjustable metering orifice is included on the cylinder means to adjust or vary the shock absorber action. When the seat is in its lowered position, the shock absorber is inactive, such that the seat has a firm position resting on the toilet bowl.

The seat-raising mechanism of this invention includes a foot pedal operator that has a front end resting on the floor surface, and a rear end elevated a slight distance above the floor surface, whereby the user can depress the pedal without raising his foot any significant distance from the floor. The user's weight is substantially evenly distributed between the two feet so there is less danger of the user losing his balance.

The seat raising mechanism can be readily remounted to accommodate the new state of the art "low boy" toilet bowl that expands when the seat is lifted and contracts when the seat is returned.

The foot pedal can be illuminated by a light so that it can be located in the dark. A lighting accessory can be mounted on the cylinder to function as a night lite that is energized when the seat reaches its vertical position.

The apparatus can be delivered assembled in its' own floor space mount.

THE DRAWINGS

FIG. 6 is another view of the motorized lifter in which the lifting lever is mounted on a pivot disposed between the piston rod pivot and the motor.

FIG. 7 is a view of the FIG. 1 embodiment but as seen from the opposite side of FIG. 1, and showing the seat in its raised position.

FIG. 8 is a view of another form of the controlled cushion, and

FIG. 9 is an enlarged fragmentary view of the air pressure controller bag.

FIG. 10 is an enlarged plan view showing the right end of the lifting lever as shown in FIG. 1.

DESCRIPTION OF A PREFERRED EMBODIMENT OF THE INVENTION

Figure 1:
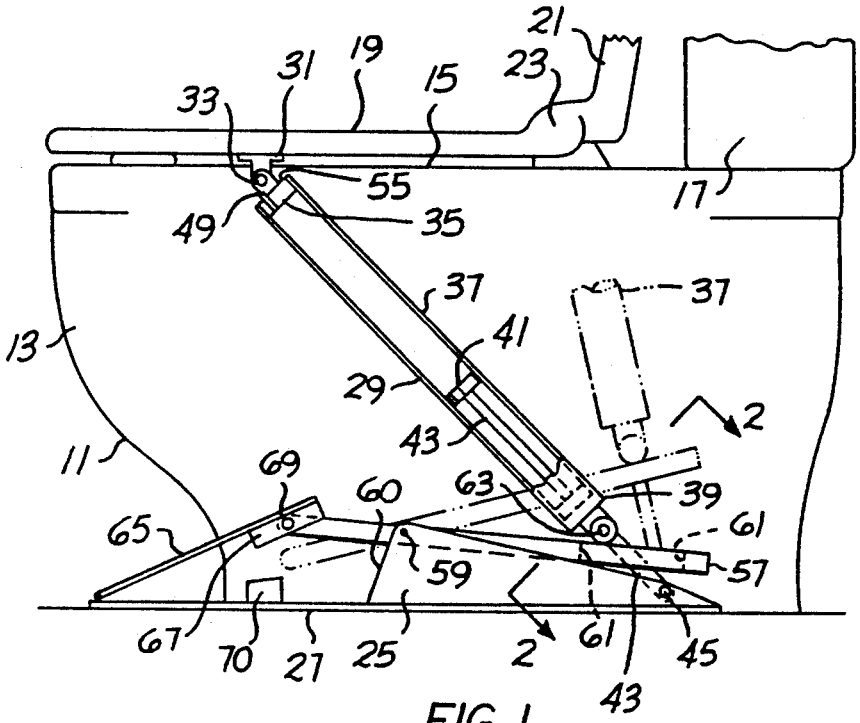
FIG. 1 is a side elevational view of a toilet equipped with a seat-raising mechanism of the present invention.

FIG. 1 shows a conventional toilet 11 that includes a toilet bowl 13 having an upper rim 15. An upstanding water tank 17 is located on the rear end of the bowl structure. A conventional toilet seat 19 and cover 21 are pivotally mounted around a horizontal pivot axis 23 in front of tank 17. The toilet seat and cover are independently swingable around axis 23, such that cover 21 is in its raised, open position, as shown in FIG. 1, while seat 19 is in its lowered position. The seat can be raised to a position resting against the front face of the cover.

A foot-operated mechanism 25 raises seat 19 without physically grasping the seat structure. The illustrated mechanism includes a flat floor plate 27 adhesively, or otherwise, secured to the floor surface for pivotally mounting the lower end of a pneumatic cylinder means 29. The upper end of the cylinder means is pivotally connected to the toilet seat by a flat plate 31 secured to the seat undersurface, and a pivot means 33 connecting plate 31 to the upper end wall 35 of the cylinder means.

Pneumatic cylinder means 29 includes an elongated tubular cylinder 37 having an upper end wall 35 and a lower end wall 39. A piston 41 is attached to a piston rod 43 for relative sliding motion in the tubular cylinder. The piston has a suitable peripheral seat, e.g. an O-ring, for preventing air flow across the piston-cylinder interface. Piston rod 43 has a pivotal connection 45 with floor plate 27.

Plate 31 engages wall 35 when cylinder 29 is fully extended or seat 19 is approximately 90° with respect to rim 15.

Figure 2:
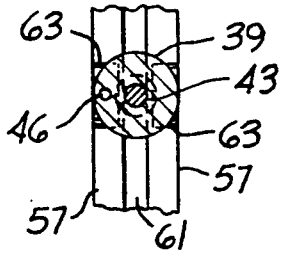
FIG. 2 is a fragmentary sectional view taken on line 2—2 in FIG. 1.
Figure 5:
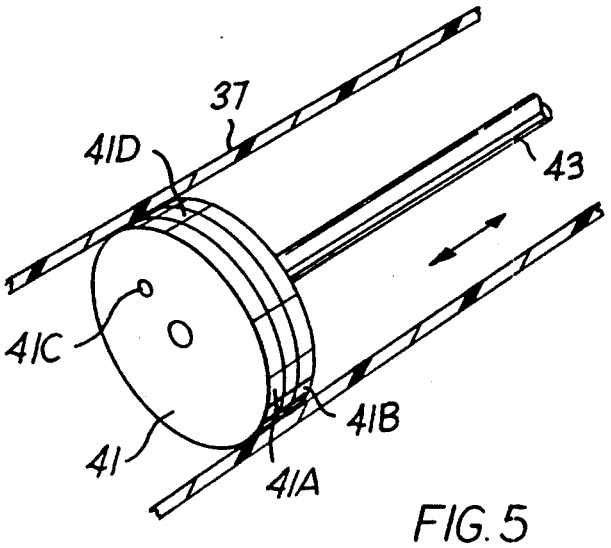
FIG. 5 is a fragmentary view of the piston head and the upper end of the cylinder.

The cylinder has an end wall 39 with an opening 46, best shown in FIG. 2. Air can freely flow into and out of the space below the piston as the area below the piston is expanded or contracted. Referring to FIG. 5, piston head 41 has two circular spaced, plates 41A and 41B. Plate 41A has a small orifice 41C. An O-ring 41D is disposed between 41B and 41A. The arrangement is such that as the piston is moving toward the upper end of the cylinder, the air between the piston head and the upper end of the cylinder becomes compressed.

Figure 3:
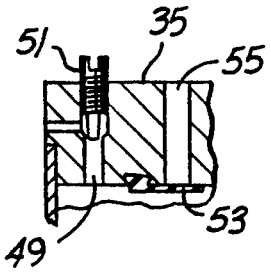
FIG. 3 is a fragmentary sectional view through an adjustable metering orifice that can be used in the FIG. 1 seat raising mechanism.

The upper end wall 35 of the cylinder has an adjustable metering orifice 49 illustrated in FIG. 3. The orifice cooperates with opening 41C in controlling the air flow out of the space above the piston. Thus as the seat is dropping, it's falling motion is controlled or monitored by the cylinder and the manner in which the air is flowing through openings 41C and 49. As the cylinder is being raised, the air flows through orifice 41C. As the cylinder is dropping, the air is trapped by O-ring 41D so that the amount of air that passes from the upper end of the cylinder is controlled by orifice 49.

Metering orifice 49 can take various forms. As shown in FIG. 3, a metering screw 51 is threaded into a tapped hole in cylinder end wall 35 so that a conical tapered end portion of the screw extends into an air flow passage communicating with the cylinder interior space. Screw 51 is screwed in to reduce the effective size of the flow passage, or unscrewed to increase the effective size of the flow passage. The screw position adjusts the rate of air flow through the metering orifice.

During the seat-raising portion of the cycle, piston 41 slides toward the lower level of cylinder 37. To facilitate such motion, atmospheric air must flow relatively freely into the space above the piston (to avoid a vacuum condition above the piston). A check valve 53 in air intake passage 55 permits unrestricted one way flow into the cylinder. When the piston is moving toward the upper end of the cylinder (during the seat-lowering cycle), valve 53 closes passage 55.

Referring to FIG. 1, a bar-like lever 57 is pivotally supported at 59 on a channel-shaped bracket 60 for swinging motion in a vertical arc between raised and lowered limiting positions. The piston rod extends freely though a longitudinal slot 61 in the lever and thence through the cylinder end wall 39 into the cylinder. End wall 39 includes a tubular extension that supports roller 63 located on the bottom wall of the cylinder, i.e. the piston rod extends upwardly in front of the roller. The roller has rolling engagement on the upper surface of lever (bar) 57.

When lever 57 is pivoted in a vertical arc, from the full line position to the dashed line position, the lever lifts cylinder 37, upwardly on piston 41. At the same time, the pneumatic cylinder assembly swings in a rearward arc, raising toilet seat 19 to approximately a vertical position in front of cover 21. Roller 63 transmits the lifting force to the cylinder while rolling on the upper surface of lever 57. The system operates at a relatively high efficiency, with minimal frictional drag.

Pivotal connection 45 is located substantially directly below the rear end of toilet seat 19, whereas pivotal connection 33 is located a substantial distance forwardly from the toilet seat rear end (relatively close to the toilet seat front end). Since pivot connection 33 is located a substantial distance from seat pivot axis 23, the raising mechanism has a relatively long moment arm around axis 23. The mechanism thus raises the seat without excessive effort by the user. During the seat raising cycle, air flows through passage 55 (FIG. 3) into cylinder 37, thereby preventing a vacuum condition in the cylinder space above piston 41. Air below the piston flows freely out of the cylinder space below piston 41 through hole 46 in cylinder end wall 39.

The user applies foot pressure to a spring-biased pedal 65 that has its front end resting on floor plate 27 and its rear end pivotally connected to the front end of lever 57. In the illustrated structure, the pedal has a channel 67 receiving the end of the lever. A pin extends transversely through the channel flanges and the bar to form a pivotal connection 69. A stationary stop means 70 limits downward motion of the pedal. The user can depress the foot pedal without raising his foot any significant distance from the floor surface. This is advantageous in that the user can operate the pedal while still maintaining his balance with his weight distributed substantially evenly on both feet.

When the user releases the pressure of his foot on pedal 65, toilet seat 19 immediately starts to fall toward its FIG. 1 position. However, the seat lowering action requires that cylinder 37 slide downwardly on piston 41, removing the air in the cylinder space above the piston. Depending on the adjusted position of metering screw 51 (FIG. 3), the air flow can be varied to adjust the cushioned descent of the seat to the FIG. 1 position. Screw 51 is set according to individual desires, to provide a controlled seat motion without the seat forcible impacting against toilet bowl rim 15. As will be appreciated, an uncontrolled falling motion of the toilet seat produces a loud banging noise that many people find objectionable.

Roller 63 is separable from lever 57. Thus, with lever 57 in its full line position, the user can grasp the toilet seat to raise and then lower the seat manually. The seat can be manually set in a raised position resting against the front face of cover 21, when the toilet is being cleaned. The seat-raising mechanism accommodates itself to toilets having some variation in the distance between toilet seat 19 and the floor. Roller 63 can have different locations along rod 43 while still achieving an operative connection with lever 57.

FIG. 1 shows an arrangement wherein lever 57 is operated by manual pressure on pedal 67 to lift pneumatic cylinder means 29.

FIG. 6 shows another arrangement wherein first class lever 100 is raised by a wall-mounted split-phase electric motor 75. Motor 75 is connected by universal joint 71 to threaded drive shaft 77. Shaft 77 is meshed with nut 79. Nut 79 is linked to lever 100 by link means 81 that has its opposite ends pivotally attached to the nut and the lower end of the lever, respectively. Lever 100 is mounted on channel-shaped fulcrum 102 located on base 103. Roller 63 engages the upper end of the lever.

Motor 75 is reversible so that it can operate in either forward or reverse. The motor is controlled by an electric toggle switch 83 having a double on forward-/reverse power actuator 85 operatively engaged with foot pedal 87. Pedal 87 has a resilient upper wall. When the user applies foot pressure on the pedal, switch 83 is actuated to energize motor 75. When the user depresses the pedal, shaft 77 rotates to push traveling nut 79 downwardly on shaft 77 until the nut engages a normally-closed limit switch 91 to stop shaft rotation. The nut pushes the lower end of the lever down to raise the toilet seat.

When the user releases foot pressure on pedal 87, the pedal is raised slightly to return switch 83 to the condition in which the motor is reversed. Shaft 77 then rotates in the reverse direction to raise nut 79 to a position where it engages stop button 89. The weight of the toilet seat serves as an impetus for this action. The seat gradually returns to its lowered position, the rate of descent being controlled by the metering orifice means shown in FIG. 3.

Pedal 87 is not physically connected to lifting lever 100. However, pedal 87 is operationally connected to the lever, such that depressing the pedal controls the lever movement (by motor 75).

The arrangement is such that as traveling nut 79 is raised, it permits cylinder 29 to descend upon piston rod 43 which is pivotally attached at 104 adjacent floor plate 27. The motor is actuated, to raise the cylinder and the toilet seat.

FIGS. 8 and 9 illustrate another form of valve means that may be employed in the cushioning cylinder. In this case, piston rod 43 has a piston head 110 with three O-rings 112, 113 and 114, slidably mounted in cylinder housing 37. A cap 115 is mounted on the upper end of housing 37 and supports pivot means 33, adapted to be pivotally connected to toilet seat 19. The cap has a small air passage 116. An air flow bladder 117 (controls the cushion return) is mounted adjacent cap 115 inside the cylinder. Bladder 115 has a peripheral lip 118 attached to the cylinder adjacent the cap. The arrangement is such that as the cylinder descends on the piston head in the direction of arrow 119, the compressed air forces bladder 117 to block air passage through vent opening 116.

When the cylinder moves in the opposite direction, away from the piston head, the vacuum condition below the bladder pulls away from opening 116, thereby permitting air to pass through opening 116 and then through openings 119 lip in a very controlled, manner.

Figure 4:
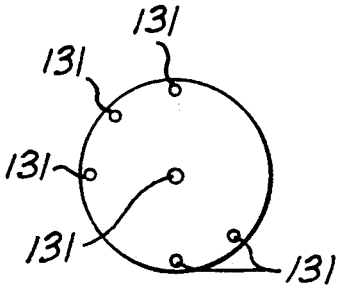
FIG. 4 shows an alternative cushion diaphragm.

FIG. 4 illustrates a diaphragm 130 that can be used instead of bladder 117. Diaphragm 130 is a flat resilient disk having a plurality of small vent holes 131, and also has its periphery attached in a sealed attachment to the cylinder. It functions in the same manner as the bladder.

Referring to FIG. 8, pivot means 33 includes a body 140 connected by rivet 142 to a bracket 144. Bracket 144 is attached to toilet seat 19, and is pivoted with respect to the body. Body 140 is attached to cylinder cap 115. The arrangement is such that as the cylinder is raised, the toilet seat is also raised, and swings until corner 146 of the bracket engages the cap to limit further raising motion and prevent the seat from striking the toilet seat cover.

The drawings show several forms that the invention can take. However, it will be appreciated that the invention can take other forms, as contemplated by the appended claims.

What is claimed is:

1. A mechanism for raising a toilet seat having a rear end, comprising:

an extensible-contractible pneumatic cylinder means having one end thereof adapted to be connected to the floor and the other end thereof adapted to be connected to a toilet seat;

said pneumatic cylinder means comprising:

an elongated cylinder having first and second ends, said first end having connection means adapted to be connected to the toilet seat;

a piston slidable within the cylinder; and a piston rod having first and second ends, said first end of said rod connected to said piston, said second end of said rod extending from the piston out of said second end of said cylinder and having connection means thereon adapted to be connected to the floor lever means controlled by a user's foot for exerting a lifting force on said cylinder, whereby said cylinder slides upwardly on said piston to raise the toilet seat; and a metering orifice in said first end of said cylinder, whereby when the toilet seat is being lowered, the cylinder slides downwardly on the piston to pressurize the air above the piston, to produce a controlled flow of air out of the cylinder through the metering orifice;

said lever means comprising a slotted bar;

said piston rod extending through a slot in said bar; and roller means mounted on said second end of said cylinder for rolling engagement on said slotted bar.

2. The seat raising mechanism of claim 1, wherein said roller means comprises an axially aligned roller carried on said second end of said cylinder such that the piston rod extends beyond the roller.

3. The seat raising mechanism of claim 1, wherein said connection means on said second end of said piston rod has a pivotal connection adapted to be connected to the floor at a floor connection point, and said connection means on said first end of said cylinder has a pivotal connection adapted to be connected to the toilet seat; the piston rod pivotal connection being located substantially directly below the rear end of the toilet seat; the cylinder pivotal connection being located a substantial distance forwardly with respect to said rear end of the toilet seat from the piston rod pivotal connection whereby the pneumatic cylinder means extends upwardly and above the floor connection point.

4. The seat raising mechanism of claim 1, and further comprising a foot pedal operationally connected to said lever means for controlling the seat-raising process; said foot pedal having a front end thereof on the floor and a rear end elevated above the floor, whereby a user can depress the pedal without raising his foot any significant distance from the floor surface.

5. The seat raising mechanism of claim 1, and further comprising a foot pedal operationally connected to said lever means for controlling the seat-raising process; said foot pedal having a front end thereof on the floor and a rear end elevated above the floor; said rear end of the foot pedal being pivotally connected to said lever means, whereby depression of the foot pedal causes the lever means to move through a vertical arc to exert a lifting force on said cylinder.

6. The seat raising mechanism of claim 1, wherein said lever means has a disengageable lifting connection with said cylinder, whereby the toilet seat can be manually grasped to raise or lower the seat without affecting said lever means.

7. The seat raising mechanism of claim 1, wherein said metering orifice is defined by an adjustable metering screw extending within an opening in said first end of said cylinder, whereby adjustment of the screw varies the size of the orifice and the air flow rate through the orifice.

8. A seat raising mechanism as defined in claim 1, including a toilet seat cover and bracket means adapted to be mounted on the seat for preventing the seat from striking the seat cover.

9. A mechanism for raising a toilet seat having a rear end, comprising:

an extensible-contractible pneumatic cylinder means having one end thereof adapted to be connected to the floor and the other end thereof adapted to be connected to a toilet seat;

said pneumatic cylinder means comprising:

an elongated cylinder having first and second ends, said first end having connection means adapted to be connected to the toilet seat;

a piston slidable within the cylinder;

a piston rod having first and second ends, said first end of said rod connected to said piston, said second end of said rod extending from the piston out of said second end of said cylinder and having connection means thereon adapted to be connected to the floor;

lever means controlled by a user's foot for exerting a lifting force on said cylinder, whereby said cylinder slides upwardly on said piston to raise the toilet seat;

a metering orifice in said first end of said cylinder;

whereby when the toilet seat is being lowered, the cylinder slides downwardly on the piston to pressurize the air above the piston, to produce a controlled flow of air out of the cylinder through the metering orifice;

an electric motor;

the lever means including a lever member having a first end and a second end, the first end being engaged with the cylinder and the second end being connected to the motor whereby the motor is operative to move the lever to exert a lifting force on said cylinder to lift said first end of said lever and said cylinder from a lower position to a raised position to lift the toilet seat.

10. The seat raising mechanism of claim 9, wherein said electric motor has a vertical threaded shaft; a nut threaded on said shaft; and including a base, means pivotally mounting the lever on the base between said first and second ends thereof, and link means connecting said nut to said second end of the lever; said motor being energizable to rotate the vertical shaft so that the nut moves downwardly along the shaft to push the link means downwardly, whereby the first end of the lever is drawn upwardly in a vertical arc to exert a lifting force on said cylinder.

11. The seat raising mechanism of claim 9, and further comprising a foot pedal operationally connected to said lever means for controlling the seat-raising process; said foot pedal having a first end thereof on the floor and a second end elevated above the floor whereby a user can depress the second end of the foot pedal; an electric motor, the lever means including a lever member having a first end and a second end, the first end being engaged with the cylinder and the second end being connected to the motor whereby the motor is operative to move the lever to exert a lifting force on said cylinder; and an electric switch means connected to said foot pedal so that depression of the pedal activates said switch means; said switch means being electrically connected to said electric motor whereby the motor is energized only when the switch means is activated by the foot pedal.

12. The seat raising mechanism of claim 9 in which the electric motor has a reversible shaft permitting the first end of said lever, the cylinder and the toilet seat to return to their respective lower positions.

13. A mechanism for raising a toilet seat having a rear end, comprising:

an extensible-contractible pneumatic cylinder means having one end thereof adapted to be connected to the floor and the other end thereof adapted to be connected to a toilet seat;

said pneumatic cylinder means comprising:

an elongated cylinder having first and second ends, said first end having connection means adapted to be connected to the toilet seat;

a piston slidable within the cylinder;

a piston rod having first and second ends, said first end of said rod connected to said piston, said second end of said rod extending from the piston out of said second end of said cylinder and having connection means thereon adapted to be connected to the floor;

lever means controlled by a user's foot for exerting a lifting force on said cylinder, whereby said cylinder slides upwardly on said piston to raise the toilet seat;

a metering orifice in said first end of said cylinder;

whereby when the toilet seat is being lowered, the cylinder slides downwardly on the piston to pressurize the air above the piston, to produce a controlled flow of air out of the cylinder through the metering orifice; and including an electric motor operatively connected to the lever means for raising the lever means to lift the cylinder, including:

a toggle switch means for energizing the motor means, and including a shaft connected to the motor means so as to be rotatable in either a first direction or in an opposite direction, and linkage means connecting the shaft means to the lever means for either raising or lowering the lever means depending upon the direction of rotation of the shaft.

14. The seat raising mechanism of claim 13 including a traveling nut mounted on the shaft means, the traveling nut being connected to the linkage means for moving the lever means, and including stop means mounted adjacent the shaft for de-energizing the motor when the traveling nut has engaged the stop means.

* * * * *